US005261594A

United States Patent [19]

Brown et al.

[11] Patent Number: 5,261,594

[45] Date of Patent: Nov. 16, 1993

[54] CONTAINER POST FOR PRODUCT PROTECTION

[76] Inventors: James M. Brown, 402 26th Ave. East, Seattle, Wash. 98112; Wallace I. Piepho, 528 Timberline Dr., South Sioux City, Nebr. 68776

[21] Appl. No.: 816,910

[22] Filed: Jan. 3, 1992

[51] Int. Cl.[5] ..... B65D 5/20

[52] U.S. Cl. ..... 229/191; 229/918; 229/919

[58] Field of Search ..... 229/191, 918, 919, DIG. 11

[56] References Cited

U.S. PATENT DOCUMENTS

| | | | |
|---|---|---|---|
| 2,794,585 | 6/1957 | Wagner | 229/191 |
| 3,917,156 | 11/1975 | Baudet | 229/191 |
| 4,056,223 | 11/1977 | Williams | 229/191 |
| 4,613,045 | 9/1986 | Watson | 229/191 |
| 4,905,834 | 3/1990 | Mur Gimeno et al. | 229/918 |
| 5,028,000 | 7/1991 | Chabot et al. | 229/191 |

FOREIGN PATENT DOCUMENTS

| | | | |
|---|---|---|---|
| 76883 | 4/1983 | European Pat. Off. | 229/191 |
| 2226546 | 7/1990 | United Kingdom | 229/918 |

*Primary Examiner*—Gary E. Elkins

[57] ABSTRACT

A paperboard container is provided with a plurality of internal vertically extending triangular-shaped columns and on the top edges of the columns there is a design feature which allows the edges to be relieved thereby forming inclined edges to reduce package tearing or product damage. The inclined edge can be provided either when the container is erected by a machine or later by hand depending upon the selected design.

4 Claims, 3 Drawing Sheets

CONTAINER POST FOR PRODUCT PROTECTION

BACKGROUND OF THE INVENTION

This invention relates generally to corrugated paperboard containers that have triangular shaped reinforcing columns within the interior and contain bagged items during shipment. More particularly, the invention relates to an improvement in the columns to reduce or eliminate bag tearing and to protect product during packing or shipment without reducing the reinforcement afforded by the columns.

There are many known paperboard container designs that utilize a substantially triangular-shaped column or post for enhancing the stacking strength. For example, in U.S. Pat. No. 3,159,326 to Stonebanks, there is illustrated a substantially rectangular paperboard container that has a plurality of upstanding triangular-shaped columns spaced along the side walls on the interior of the container. These posts extend from the bottom surface to the top surface and provide enhanced stacking strength when a plurality of containers are stacked one atop another. A similar vertical triangular-shaped post is illustrated in U.S. Pat. No. 4,948,033 to Haisell, II et al. assigned to the Mead Corporation of Dayton, Ohio. In the Haisell, II et al. patent a plurality of triangular-shaped vertically extending posts are illustrated as being spaced about the walls on the interior of a paperboard container.

In both of these examples the top edges of the posts are substantially in a horizontal plane with the edges of the paper material being exposed.

A problem has been detected in the use of the triangular-shaped posts when bagged materials are packed within the corrugated paperboard container. The relatively sharp horizontal exposed edges of the tops of the triangular posts have oftentimes caused plastic bags and the like to rip thereby allowing product to become contaminated or to be spilled during the course of shipment. Additionally, sometimes produce or fruit is damaged, if not placed into bags, as they are packed in containers with relatively sharp triangular shaped posts. It thus became apparent an improvement was needed that reduced the problem with bag tearing or product harm without sacrificing the enhanced stacking strength provided by the triangular-shaped vertically extending posts. It was found that through the use of the present invention tearing can readily be eliminated without sacrificing stacking strength.

Accordingly, from the foregoing, one object of the present invention is to reduce bag tearing when utilizing vertically extending triangular-shaped posts within the interior of a paperboard container.

Yet another object of the present invention is to provide triangular shaped posts that eliminate the problem with tearing while maintaining substantially the same enhanced stacking strength.

These and other objects of the present invention will become better understood upon referring to the specification to follow in conjunction with the attached drawings.

SUMMARY OF THE INVENTION

Briefly stated, the present invention is practiced in one form by providing at least one substantially triangular-shaped post along an interior wall of a corrugated paperboard container which extends from the bottom surface substantially to the top edge of the container.

Along the upper edge of the vertically extending post a configuration is provided with a cutout, score lines, or the like, or a combination thereof which allow the two uppermost side edges of the post to be located in an inclined orientation relative to elongated sides of the triangular posts. The inclination on the upper edges is to eliminate the sharp edge present when the uppermost edges are in a horizontal plane while providing substantially the same columnar stacking strength.

DESCRIPTION OF THE PREFERRED EMBODIMENT

Figure 1:
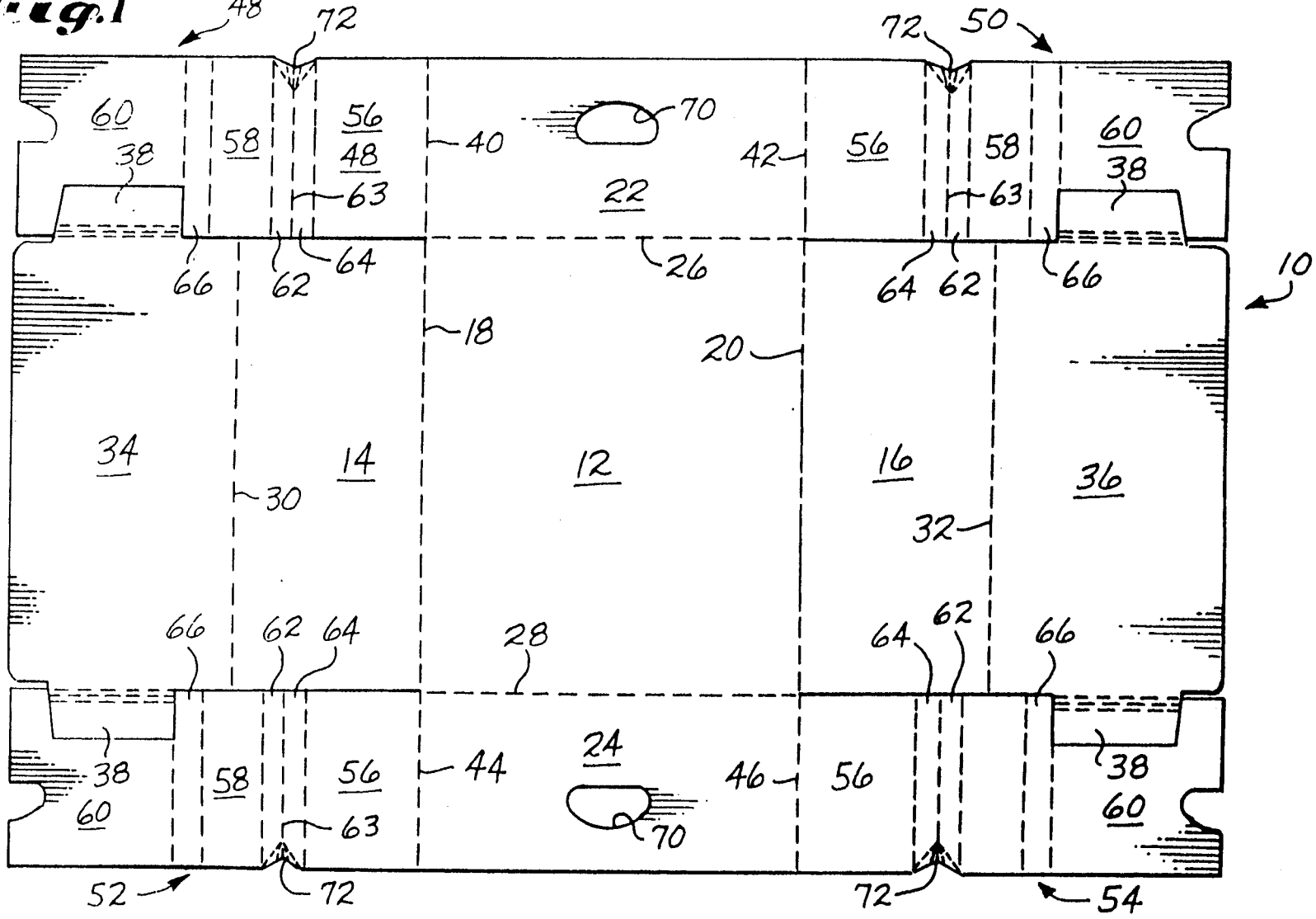
FIG. 1 is a top plan view of a single piece paperboard blank which incorporates the improvement of the present invention.

Turning first to FIG. 1, a cut and scored paperboard blank is generally indicated at 10. Paperboard blank 10 is constructed from a single flat sheet of typical paperboard material which can be of the corrugated type where two sheets of liner overlay a corrugated core. Such containers are often referred to as shipping containers. By the term single piece it is meant that when the single flat sheet is cut and scored there will be formed individual interacting elements which cooperate in the form of the erected container after the suitable erection process is complete. Multi-piece containers can also incorporate the present invention.

The embodiment disclosed herein will be illustrative of a single-piece blank which will result in a six-sided, generally rectangular shipping container. The blank form is comprised of a bottom wall 12, two elongated side walls 14, 16 connected to bottom wall 12 by way of score lines 18, 20, respectively. Extending outwardly from bottom wall 12 are the end walls 22, 24, likewise connected to the bottom wall by score lines 26, 28. Extending further outwardly from side walls 14, 16 in a hinged fashion by way of score lines 30, 32 are the top closure panels 34, 36. Extending outwardly from each closure panel 34, 36 is a closure tab 38 which may be glued or otherwise affixed to the outside of the respective end wall after packing and closure of the container. Extending outwardly from the side edges of end walls 22, 24 from score lines 40, 42, 44 and 46 are vertical reinforcing panels, each indicated respectively at 48, 50, 52 and 54. Each of these panels is further divided into first, second,and third portions indicated at 56, 58 and 60 on each of the respective reinforcing panels. Interposed between first and second portions 56, 58 on each reinforcing panel in side-by-side relationship are strength enhancing panels 62, 64. And interposed between second and third portions 58, 60 in each reinforcing panel, respectively, is an additional single reinforcing panel 66.

Figures 2, 3:
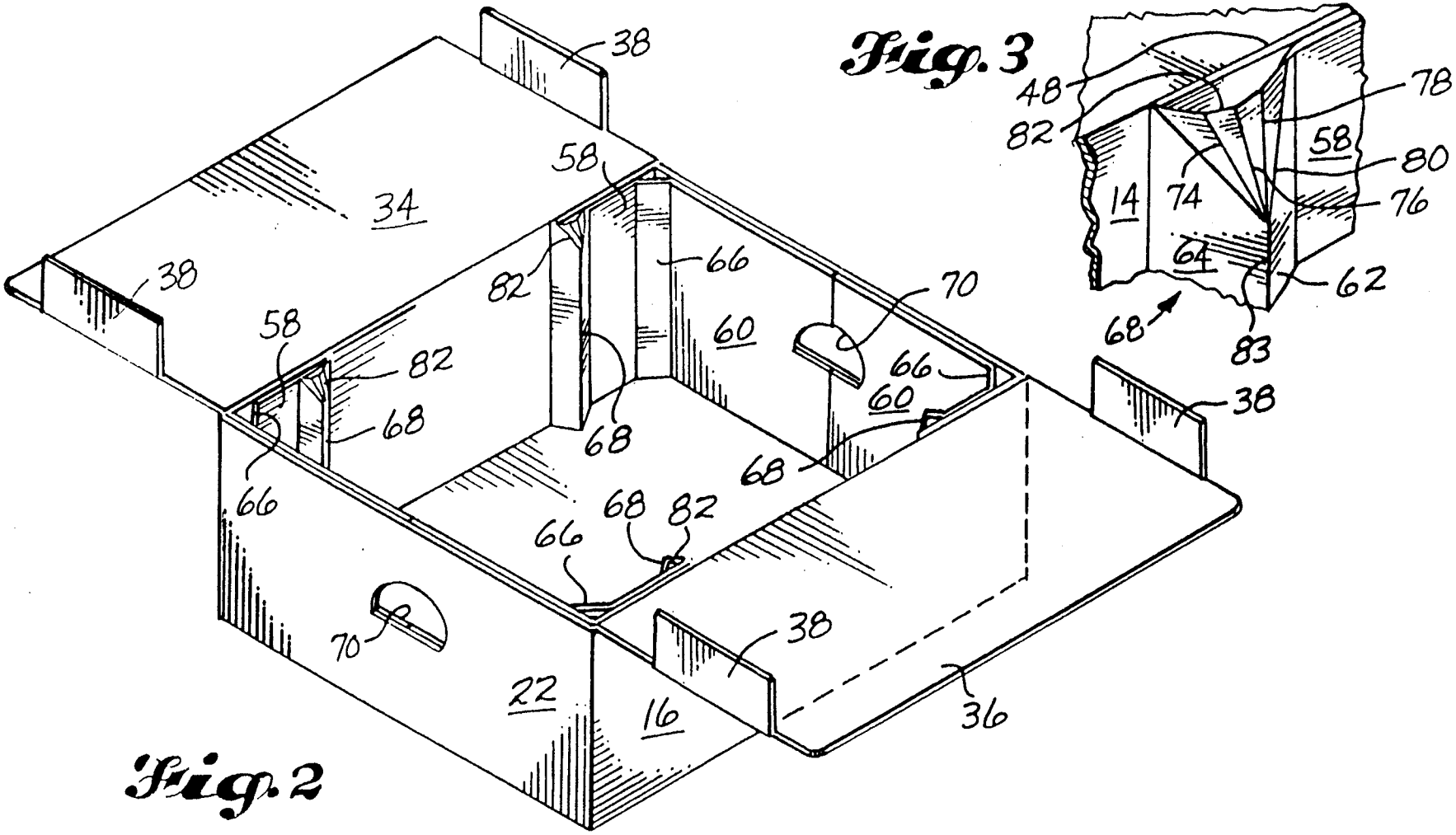
FIG. 2 is a perspective view showing the single piece paperboard blank folded up into the erected container configuration with the improved triangular posts.
FIG. 3 is a close-up view illustrating the improved feature of the present invention and the details at the top edge of the triangular-shaped post.

This particular construction for a single-piece shipping container is known and it will be appreciated particularly when referring to FIG. 2 that all of the interconnected cooperating panels will be foldable whereby the erected container as depicted in FIG. 2 will be ready to accept product. As may be clearly seen in FIG. 2, side walls 14, 16 are in a vertical upstanding orientation as are the two end walls 22, 24. The top closure panels 34, 36 are open until product is packed within the container. Usually when this type of container is erected it will be done on a mechanical machine whereby the respective flaps will be folded and glue applied to adhere the juxtaposed panels together. For example, it can be seen that the back surface of the first portion 56 will be bonded to an inside portion of a side wall. The side-by-side strength enhancing panel 62, 64 will then be folded to form the vertical triangular-shaped (in cross section) columns, each of which are indicated at 68 in FIG. 2. The second portion 58 of each respective reinforcing panel is then folded back to lay flat against the exposed surface of the underlying first portion 56 and it is bonded thereto. The single reinforcing panels 66 are then angled across the corner as shown in FIG. 2 to form yet another vertically upstanding triangular-shaped column in each of the four corners. Finally, the third portion in each respective reinforcing panel is folded to lay flat against the inside surface of the adjacent end wall where it will be bonded thereto. As seen in Figs. 1 and 2, opposed hand holds are provided and they are indicated at 70.

Turning now to a description of the particular improved feature forming the present invention, it will be noted that the triangular-shaped vertical columns 68 have a modified uppermost edge. Referring particularly to FIG. 3, it will be seen that at the upper ends of adjacent side-by-side panels 62, 64, there are inclined edges together with a plurality of score lines as will now be explained.

First, a triangular-shaped cutout indicated at 72 is provided in the edge of the reinforcing Is which cutout bridges the ends of the side-by-side panels 62, 64. Along the top V-shaped edges a plurality of downwardly inclined score lines are provided indicated at 74, 76, 78 and 80. These score lines coupled with that portion of score line 63 separating adjacent panels 62, 64 allow the top portion of each triangular-shaped column 68 to be folded back inwardly so as to create an inclined surface. The purpose is to create a smoother upper edge portion on each column which will thereby significantly reduce or eliminate altogether the tearing of a package containing product or minimize damage to unbagged fruit and produce placed within the erected container. These top inclined edges are indicated generally at 82 in FIG. 2 and will form an angle with the horizontal of from about 40°-70°. Even with the top edges having such an angular orientation, stacking strength is not reduced to any significant degree.

Figure 5:
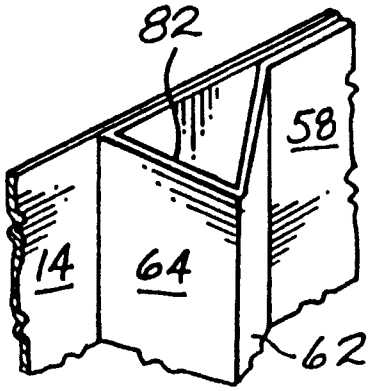
FIG. 5 is a close-up view illustrating the downwardly inclined upper edge of the FIG. 4 embodiment.
Figure 4:
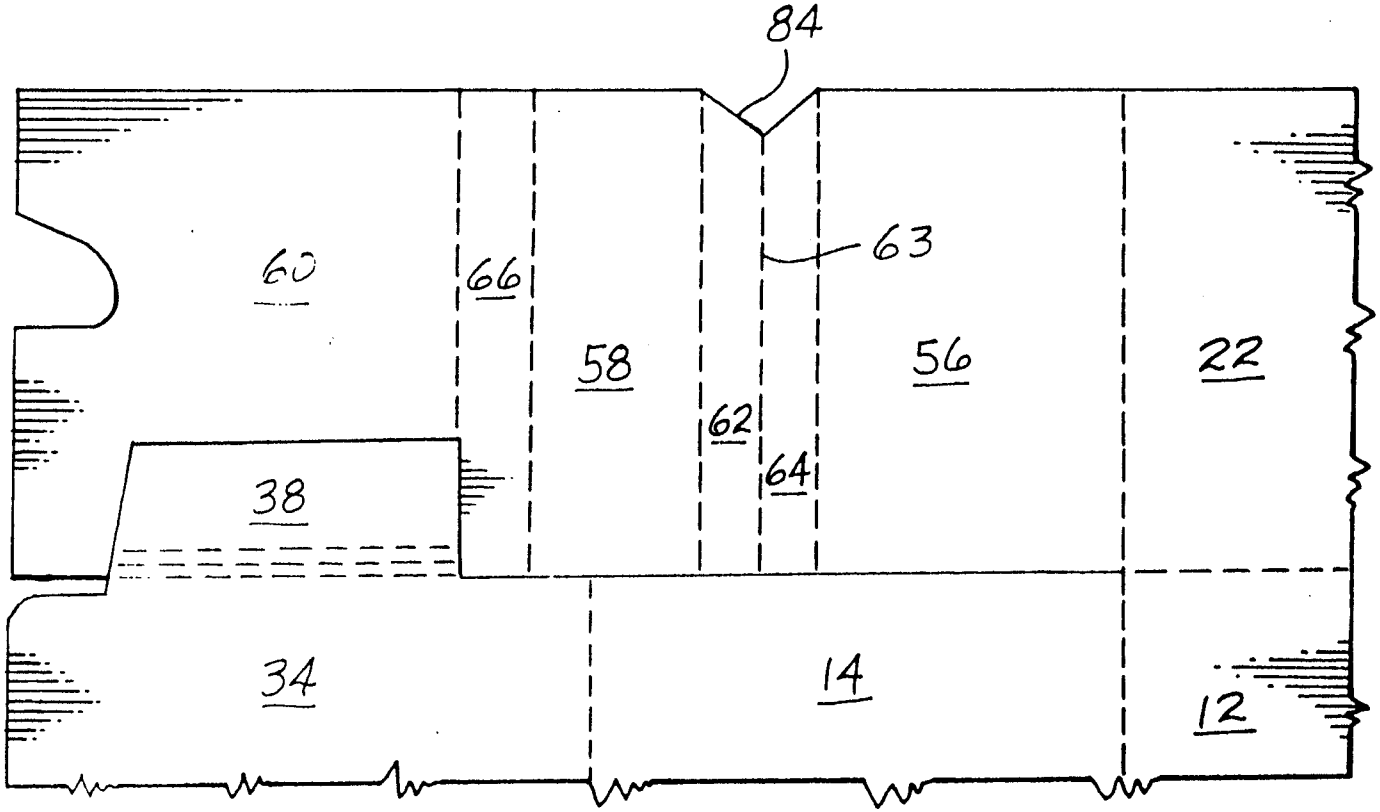
FIG. 4 is a view similar to FIG. 3 showing an alternate for the top edge configuration.

As an alternate design, FIG. 4 illustrates the use of a triangular shaped cutout, indicated at 84, without the use of score lines. The cutout 84 will be deeper than the embodiment of FIGS. 1-3 in order to allow the 40°-70° angle to be formed, in this case, solely from the cutout. This design will also reduce bag and product damage without materially altering the stacking strength provided by the triangular posts. In FIG. 5 a detail view is shown to illustrate the downward incline of the upper edge.

Thus, what has been described is an improvement to a paperboard container having vertically extending columns within the interior for strength enhancement. The particular improvement relates to upper inclined edges on the columns. While several particular embodiments have been disclosed, other ways of accomplishing the same purpose may occur to those skilled in the art. All such changes and modifications are intended to be included within the scope of the appended claims.

We claim:

1. In a paperboard container of a type having upstanding side walls and a bottom wall together with at least one substantially triangular shaped upstanding reinforcing post extending from the bottom wall to a top of an adjacent one of said side walls and said reinforcing post having a pair of side-by-side strength enhancing panels with top edges extending into the container, having the improvement comprising:

the top edges being relieved so they are inclined downwardly with respect to the top of the adjacent side wall.

2. The container as in claim 1 in which two of the top edges of the triangular shaped post are relieved so together they form a downwardly inclined top edge on the post.

3. The container as in claim 1 in which two of the top edges of the triangular shaped post are scored to form V-shaped score lines which are inclined inwardly and downwardly.

4. The container as in claim 1 in which there is a V-shaped cutout at the top edges of two adjacent sides in the triangular post.

* * * * *

UNITED STATES PATENT AND TRADEMARK OFFICE

CERTIFICATE OF CORRECTION

PATENT NO. : 5,261,594

DATED : November 16, 1993

INVENTOR(S) : James M. Brown and Wallace I. Piepho

It is certified that error appears in the above-indentified patent and that said Letters Patent is hereby corrected as shown below:

On the Title Page

Please add Item 73 as follows:

[73] Assignee: Weyerhaeuser Company, Tacoma, Wash. and IBP, Inc. Dakota Dunes, S. Dak.

Signed and Sealed this

Twelfth Day of August, 1997

Bruce Lehman

*Attest:*

BRUCE LEHMAN

*Attesting Officer*

*Commissioner of Patents and Trademarks*